US010662976B2

(12) United States Patent
Guth et al.

(10) Patent No.: US 10,662,976 B2
(45) Date of Patent: May 26, 2020

(54) ELECTROHYDRAULIC DRIVE UNIT

(71) Applicant: HOERBIGER AUTOMATISIERUNGSTECHNIK HOLDING GMBH, Altenstadt (DE)

(72) Inventors: Stefan Guth, Hohenfurch (DE); Martin Rauwolf, Schongau (DE)

(73) Assignee: HAWE ALTENSTADT HOLDING GMBH, Altenstadt (DE)

( * ) Notice: Subject to any disclaimer, the term of this patent is extended or adjusted under 35 U.S.C. 154(b) by 0 days.

(21) Appl. No.: 16/268,126

(22) Filed: Feb. 5, 2019

(65) Prior Publication Data

US 2019/0170163 A1 Jun. 6, 2019

Related U.S. Application Data

(63) Continuation of application No. PCT/EP2017/065630, filed on Jun. 26, 2017.

(30) Foreign Application Priority Data

Oct. 5, 2016 (DE) ..... 10 2016 118 853

(51) Int. Cl.
*F15B 11/02* (2006.01)
*B30B 15/20* (2006.01)
(Continued)

(52) U.S. Cl.
CPC ..... *F15B 11/022* (2013.01); *B30B 15/20* (2013.01); *F15B 1/02* (2013.01); *F15B 1/021* (2013.01);
(Continued)

(58) Field of Classification Search
CPC .. F15B 11/02; F15B 1/02; F15B 1/021; F15B 1/027; B30B 15/20
See application file for complete search history.

(56) References Cited

U.S. PATENT DOCUMENTS

2012/0260642 A1 10/2012 Opdenbosch et al.

FOREIGN PATENT DOCUMENTS

DE 40 36 564 A1 5/1992
DE 43 14 801 A1 11/1994
(Continued)

OTHER PUBLICATIONS

International Search Report issued by the International Search Authority for corresponding International Application No. PCT/EP2017/065630 dated Oct. 16, 2017 with an English translation.
(Continued)

*Primary Examiner* — Michael Leslie
*Assistant Examiner* — Daniel S Collins
(74) *Attorney, Agent, or Firm* — Myers Wolin, LLC

(57) ABSTRACT

An electrohydraulic drive unit is provided, comprising a cylinder-piston assembly having a piston-side first hydraulic working chamber and a piston-rod-side second hydraulic working chamber, a tank, a hydraulic pump, which can be driven at variable rotational speed and which has a tank connection point and a working connection point, a valve assembly, which is connected between the working connection point of the hydraulic pump and the cylinder-piston assembly, and an anti-cavitation valve, which is connected between the tank and the first hydraulic working chamber; and a machine controller. Switching valves of the valve assembly can be switched between loading of the first hydraulic working chamber and loading of the second hydraulic working chamber of the cylinder-piston assembly during pumping operation of the hydraulic pump from the working connection point of the hydraulic pump by the machine controller.

11 Claims, 2 Drawing Sheets

(51) Int. Cl.
*F15B 1/02* (2006.01)
*F15B 1/027* (2006.01)

(52) U.S. Cl.
CPC ..... *F15B 1/027* (2013.01); *F15B 2211/20515* (2013.01); *F15B 2211/20561* (2013.01); *F15B 2211/212* (2013.01); *F15B 2211/275* (2013.01); *F15B 2211/30505* (2013.01); *F15B 2211/55* (2013.01); *F15B 2211/625* (2013.01); *F15B 2211/7053* (2013.01); *F15B 2211/775* (2013.01)

(56) References Cited

FOREIGN PATENT DOCUMENTS

| | | | |
|---|---|---|---|
| DE | 10 2005 029 822 | A1 | 10/2006 |
| DE | 10 2009 052 531 | A1 | 5/2011 |
| DE | 102011056894 | A1 | 11/2012 |
| DE | 10 2012 013 098 | A1 | 1/2014 |
| DE | 11 2012 005 015 | T5 | 8/2014 |
| DE | 10 2014 005 352 | A1 | 10/2015 |
| DE | 10 2014 218 887 | B3 | 1/2016 |
| DE | 202015 106 161 | U1 | 1/2016 |
| EP | 0103727 | A1 | 3/1984 |
| EP | 0311779 | A2 | 4/1989 |
| WO | 02/24441 | A1 | 3/2002 |
| WO | 2011/003506 | A1 | 1/2011 |
| WO | 2012/112130 | A1 | 8/2012 |

OTHER PUBLICATIONS

Written Opinion of the International Search Authority issued by the International Search Authority for corresponding International Application No. PCT/EP2017/065630 dated Oct. 16, 2017 with an English translation.

ELECTROHYDRAULIC DRIVE UNIT

CROSS REFERENCE TO RELATED APPLICATIONS

This application is a continuation under 35 U.S.C. § 120 of International Application PCT/EP2017/065630, filed Jun. 26, 2017, which claims priority to German Application No. 10 2016 118 853.0, filed Oct. 5, 2016, the contents of each of which are incorporated by reference herein.

FIELD OF THE INVENTION

The present invention relates to an electrohydraulic drive unit.

BACKGROUND

Electrohydraulic drive units, which—constructed as linear drives—respectively comprise at least one cylinder-piston arrangement that can be pressurized in controlled manner by a hydraulic pump and in particular are suitable as machine drives are known in various configurations. In this regard, reference may be made, for example, to DE 102014005352 A1, DE 102012013098 A1, DE 102009052531 A1, DE 4036564 A1, DE 102005029822 A1, DE 4314801 A1, WO 2012/112130 A1, WO 2011/003506 A1, EP 103727 A1, DE 102014218887 B3 and DE 202015106161 U1.

An electrohydraulic drive unit of the said generic type can be inferred in particular from the last cited DE 202015106161 U1. One of the characteristics then consists in the fact that the hydraulic pump together with its working port may be connected optionally to each of the two hydraulic working chambers of the—double—acting—cylinder-piston arrangement. Hereby the piston of the cylinder-piston arrangement may be moved—by appropriate pressurization of one of the two hydraulic working chambers from the hydraulic pump—actively in each of the two directions of movement (lowered as well as raised in the case of vertical axis of movement). In a typical application of such an electrohydraulic drive unit, a first part of the downward movement of the piston (the so-called rapid traverse) during a working cycle, with the servo-suction valve open, takes place due to gravity alone with displacement of hydraulic fluid from the second hydraulic working chamber into the tank, wherein the displacement is braked by the hydraulic pump switched to braking mode. Following a changeover phase, which typically runs shortly before the tool is set on the workpiece during use of the drive unit in a press, the second part of the downward movement of the piston (the so-called power mode) takes place, as does the subsequent holding of the piston at the bottom dead center under pressurization of the first hydraulic working chamber from the hydraulic pump in its pumping mode, wherein hydraulic fluid is displaced from the second hydraulic working chamber against an opposing pressure generated by a pressure-holding valve into the tank during the power mode.

In various applications, the piston of the cylinder-piston arrangement is under considerable tension at its bottom dead center. This is the case, for example, during application of the respective electrohydraulic drive unit in a straightening or bending press or in a press brake, in which the workpiece to be formed—depending on its material properties and dimensions—typically exerts on the piston, at the bottom dead center thereof, a high opposing force directed against the piston movement causing the forming process. Accordingly, in such applications, the first hydraulic working chamber of the cylinder-piston arrangement is under considerable pressure at the bottom dead center of the piston. In order to dissipate this pressure before the piston—due to pressurization of the second hydraulic working chamber—is actively raised, a so-called decompression phase following the holding phase is provided according to DE 202015106161 U1. For this purpose—without change of the connection of the first hydraulic working chamber of the cylinder-piston arrangement to the working outlet of the hydraulic pump—the directions of rotation and flow of the hydraulic pump, which in the forming and holding phase pressurizes the first hydraulic working chamber, are reversed. The return flow of hydraulic fluid from the first hydraulic working chamber via the hydraulic pump—now operating in braking mode—to the tank is then limited, according to DE 202015106161 U1, via a flow throttle. The latest end of the decompression phase is then dictated by the process itself, namely at the latest at the point of equilibrium between the forces acting on the piston (especially hydraulic forces, weight forces, reaction forces or resilience forces of the workpiece, resilience forces of the machine parts deformed elastically during pressing), wherein the tool is still typically bearing on the workpiece at this time. After decompression in this sense has taken place, reversal of the hydraulics is commanded in the sense of pressurization—causing active raising of the piston—of the second hydraulic working chamber by the hydraulic pump, which has been switched back to pumping mode.

The present invention has taken on the object of providing an electrohydraulic drive unit of the generic type that is characterized by further improved operating behavior, especially in the region of reversal of movement of the piston of the hydraulic cylinder-piston arrangement.

SUMMARY

The foregoing object is achieved according to the present invention, by outfitting a generic electrohydraulic drive unit having a hydraulic decompression module with a hydraulic accumulator, which can be placed in communication with the second hydraulic working chamber via a first connecting line having a pressure-limiting valve having flow direction from the second hydraulic working chamber to the hydraulic accumulator and via a second connecting line having a check valve opening in flow direction from the hydraulic accumulator to the second hydraulic working chamber. An inventive electrohydraulic drive unit is characterized, in other words, in that a decompression module having a hydraulic accumulator connected in specific manner to the second hydraulic working chamber is integrated in the hydraulic system.

Since the inventive drive unit is suitable in quite special manner as a press drive, wherein the piston drives a reciprocatingly movable tool used for forming of a workpiece, the present invention will be explained hereinafter mainly in relation to that use. Nevertheless, a limitation of the invention to that use cannot be inferred from this.

The integration, characteristic of the present invention, of a hydraulic accumulator into the rest of the hydraulic system by means of the first and of the second connecting line and the valves disposed therein, makes it possible in particular to decouple, from the interaction with a workpiece or the like being formed, the pressure ratios in the two hydraulic working chambers of the cylinder-piston arrangement and the movement of the piston in the particularly critical phase of pressure dissipation in the first hydraulic working chamber and the beginning of return movement of the piston, by the fact that the decisive variable is not a force induced in the piston by the workpiece or the like being formed during the said pressure dissipation in the first hydraulic chamber and the beginning of return movement of the piston, but instead is the hydraulic pressure induced in the second hydraulic working chamber by the decompression module. In this way, among other benefits, good reproducibility of the working cycle can be achieved, as can process control that is particularly gentle for the workpiece. Synergetic effects of several influences cooperating in combination are of predominant significance for the achievable, particularly favorable results. Thus, in the region of the transition from the power mode via the holding phase at bottom dead center to the beginning return stroke of the piston, the hydraulic pump does not have to be changed over from the first to the second hydraulic working chamber; instead, it remains uninterruptedly in communication with the first hydraulic working chamber and at first alone reduces (in jerk-free and steady manner) the rpm in pumping mode and then changes over to braking mode during reversal of the direction of rotation. Even switching valves are not changed over in this critical phase, and so unsteady phenomena induced by changeover processes of the switching valves are also avoided. In other respects, the return stroke of the piston in the decompression phase is not determined and limited by the elastic resilience of the workpiece and of the machine parts elastically deformed during pressing; instead, the decompression module dictates the extent of the return stroke of the piston during the decompression phase. Thus, during the decompression phase, which therefore may also represent a "return-stroke creep mode", depending on individual design of the cycle, it is possible, by means of the hydraulic decompression module, to raise the piston in continuous, steady and jerk-free (active) manner so far that no contact of any kind exists any longer between tool and workpiece. In this way, unsteady phenomena, such as then necessarily occur—due to various switching processes—during the transition to active raising of the piston in the rapid traverse (during pressurization of the second working chamber from the hydraulic pump in pumping mode), cannot act detrimentally on the workpiece. And since, during any braking operation in the "decompression phase", the hydraulic pump remains in communication with the first hydraulic working chamber, the effective piston area of which is regularly larger by a multiple than the effective piston area of the second hydraulic working chamber, particularly sensitive movement control of the piston is additionally possible, decisively more sensitive than in the return stroke under active pressurization of the second hydraulic working chamber from the hydraulic pump. By reduction of the influence of reverse actions (e.g. resilience) of an unformed workpiece or the like in the decompression phase, a highly steady force and movement variation of this phase may furthermore be achieved. And, by the fact that the loading of the hydraulic accumulator of the hydraulic decompression module from the second hydraulic working chamber takes place via a pressure-limiting valve, which is disposed in the first connecting line and which may be identical to the pressure-limiting valve that is active during power mode in conventional electrohydraulic drive units, the inventive integration of a hydraulic decompression module into the hydraulic system does not have any effects relevant to safety by comparison with the prior art.

All of these positive effects explained in the foregoing are of quite considerable advantage and benefit for various applications of the electrohydraulic drive unit under consideration here. In particular, by using inventive drive units, even powder presses can be designed in which the green compact is treated especially gently following pressing, and so an especially low defect and rejects rate can be achieved. By virtue of its outstanding characteristic advantages, the present invention is likewise very well suited for application in press brakes for sensor-regulated bending. This is so because the steady and jerk-free active decompression stroke that is possible by application of the invention, and that continues until complete raising of the tool from the workpiece and even beyond, is ideal for the post-bending cycle, which takes place following the first bend applied on the basis of calculated values for the punch and which—after the punch has been completely raised from the workpiece—comprises instrumental sensing of the actual size of the workpiece as well as determination of the necessary feed motion of the punch. This is also obviously the case during passage through several post-bending cycles in "pendulum operation". In forming processes that take place using bending aids due to the specific workpiece geometry, the present invention likewise proves to be extremely beneficial; this is so because the full trajectory control during active decompression permits controlled transfer of the workpiece to the bending aid. This is also correspondingly the case for controlled deposition of a heavy workpiece (after it has been machined) on a shelf using the effect of the tool being moved in precisely controlled manner; uncontrolled falling of the workpiece can be prevented in this way, which is advantageous both in the safety-related respect and for the quality of the workpiece surface.

According to a first preferred further development of the present invention, the hydraulic decompression module comprises a loading/unloading valve, which particularly preferably is disposed in a line section common to the first connecting line and the second connecting line. By means of the said loading/unloading valve, the effective interaction of the hydraulic accumulator of the hydraulic decompression module with the second hydraulic working chamber can be limited to a portion (preferably small) of the working cycle (more or less adjacent to bottom dead center of the piston), and so the hydraulic accumulator is separated from the second hydraulic working chamber during the preponderant portion of the respective working cycle. The hydraulic fluid displaced from the second hydraulic working chamber after the hydraulic decompression module has been connected and during the further approach of the piston to bottom dead center is forced through the first connecting line into the hydraulic accumulator of the hydraulic decompression module. The point of effective connection of the decompression module during the downward movement of the piston—due to opening of the loading/unloading valve—is then preferably chosen such that the hydraulic energy stored in the hydraulic accumulator of the decompression module and the volume of accumulated hydraulic fluid are sufficient to raise the piston during the decompression phase (which includes an active "return-stroke creep mode") so far that contact no longer exists between tool and workpiece.

In typical cases of application of the invention, the corresponding connection of the hydraulic decompression module via the loading/unloading valve during the changeover phase that is present in any case may take place for this purpose at the end of the rapid traverse (see hereinabove)—executed in braking mode. This is favorable with regard to the possibility of coordinated timing of the shutoff of the line connection of the second hydraulic working chamber to the tank. Nevertheless, this is not imperative; this is so because, depending on the individual working cycle, connection of the decompression module at a later time, only during the power mode of the piston, possibly also offers advantages. Limitation of the effective connection of the decompression module to the part of the working cycle necessary for achievement of the advantages described hereinabove acts positively, among other ways, to the effect that the hydraulic accumulator of the decompression module can be designed to be correspondingly small. This not only has cost benefits; it is also favorable in view of the sometimes restricted space conditions at the machine in question. In general, it is true (even for connection of the hydraulic decompression module in the changeover phase from rapid traverse to power mode) that the capacity of the hydraulic accumulator of the decompression module may be substantially smaller than the maximum volume of the second hydraulic working chamber, for example may amount to only less than 30% thereof.

As regards connection of the hydraulic decompression module by opening of the loading/unloading valve, it is possible in particular—in yet another preferred further development—to open the loading/unloading valve in pressure-controlled manner, wherein the control-pressure line communicates with the first hydraulic working chamber. In this way, depending on the specified threshold value, the decompression module is automatically connected, as it were, right at the beginning or else during the power mode upon attainment of a specified pressure value in the first hydraulic working chamber. If connection right at the beginning of power mode is desired, the threshold value of switching of the loading/unloading valve is matched to that pressure jump which develops in the first hydraulic working chamber during the transition from rapid traverse to power mode. For connection of the decompression module at a later time, during power mode, the threshold value of switching of the loading/unloading valve is matched, for example, to that pressure jump which develops upon setting of the tool on the workpiece. By specifying an even higher switching pressure, it may also be possible to adjust an even later switching point, namely more or less toward the end of the power mode, when the pressure in the first hydraulic working chamber is correspondingly high.

The pressure-dependent connection of hydraulic decompression modules by pressure-controlled opening of the loading/unloading valve can be realized by, for example, direct hydraulic actuation of the loading/unloading valve via the control pressure. A noteworthy advantage of such direct pressure actuation of the loading/unloading valve consists in the fact that the machine controller does not need to have any special control output for actuating the loading/unloading valve. In the individual case, however, such pressure-controlled actuation of the loading/unloading valve may also be expedient in which the pressure used for control of the loading/unloading valve is acquired by means of a sensor and the corresponding measured value is relayed to the machine controller, which in turn activates a positioning drive (especially electrical) acting on the loading/unloading valve and and actuating it. However, pressure-controlled actuation (directly or indirectly) of the loading/unloading valve in the foregoing sense is only one of the suitable options for implementing the present invention. Thus, for example, the loading/unloading valve may also be actuated manually (e.g. by means of a foot pedal) or by an electrical positioning drive controlled in some other way (e.g. status-controlled or sequence-controlled) by the machine controller. In the individual case (e.g. even from viewpoints of the "Emergency-off function, of equipment complexity and of density), the latter may be the most favorable, tangible implementation of the present invention.

During the transition of the hydraulic pump to braking mode, in such a way that hydraulic fluid flows in braked manner out of the first hydraulic working chamber (via the hydraulic pump working in braking mode) and back into the tank, the decompression module is respectively effective (in the sense of pressurization of the second hydraulic working chamber from the hydraulic accumulator via the second connecting line) until the pressure in the first hydraulic working chamber again sinks below the switching pressure of the loading/unloading valve. From this point on, the further working cycle takes place without being affected by the decompression module. In other words, it is therefore possible in this configuration for the hydraulic accumulator to be automatically loaded from the second hydraulic working chamber only during the power mode or even only part thereof during the working cycle, to the extent necessary for pressurization of the second hydraulic working chamber from the hydraulic accumulator via the second connecting line during the phase of controlled active decompression (together with return-stroke creep mode if applicable).

Another preferred further development of the invention is characterized in that the hydraulic pump, which can be reversed by means of the machine controller in braking mode such that the directions of rotation and flow are reversed compared with pumping mode, is designed as a 2-quadrant pump. This further development takes advantage of the capability of using relatively simple, inexpensive and reliable pump engineering for implementation of the concept underlying the invention.

According to yet another preferred further development of the invention, a filter unit is connected between the working port of the hydraulic pump and the valve arrangement. The said filter unit comprises a filter, through which hydraulic fluid being conveyed by the hydraulic pump flows during pumping mode. In braking mode, the hydraulic fluid is guided via a bypass around the filter unit. This arrangement and configuration of the filter unit is characterized by particularly high efficiency.

BRIEF DESCRIPTION OF THE DRAWING

The present invention will be explained in more detail hereinafter on the basis of a preferred exemplary embodiment illustrated in the drawing, wherein.

DETAILED DESCRIPTION OF THE PREFERRED EMBODIMENTS

Figure 1:
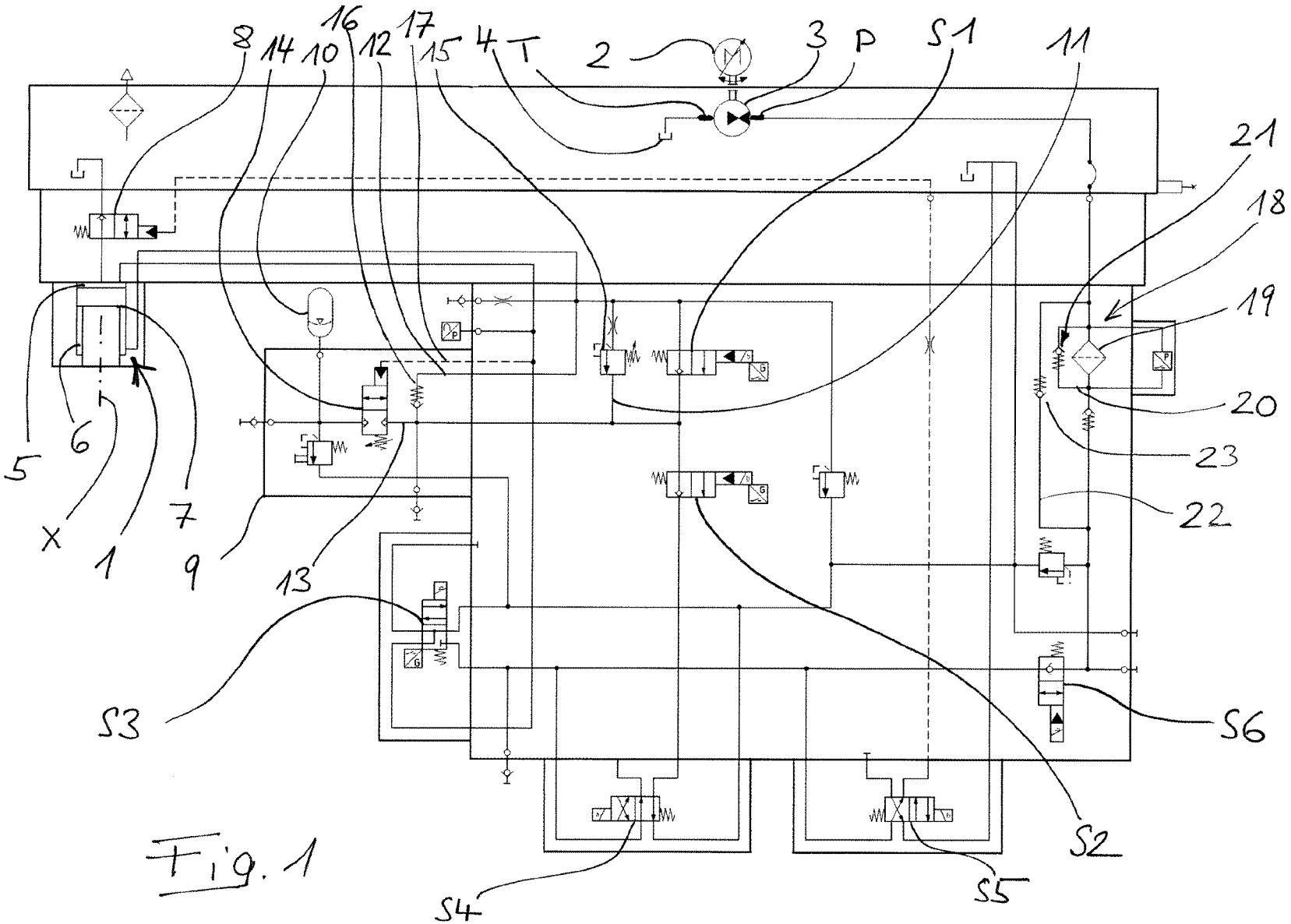
FIG. 1 shows a hydraulic diagram of connections and FIG. 2 shows a functional diagram of the exemplary embodiment.

The electrohydraulic drive unit according to the exemplary embodiment corresponds to a considerable extent to that drive unit described and explained in detail in DE 202015106161 U1. Within the scope of this agreement with the prior art, a separate detailed explanation is not needed at this point, but instead reference is made to DE 202015106161 U1, the entire disclosure content of which is included by reference in the content of the present patent application.

The illustrated electrohydraulic drive unit, as is suitable in particular for use on a machine press such as a straightening or bending press, a press brake or else a powder press, for example, comprises a hydraulic cylinder-piston arrangement 1, a hydraulic pump 3 (2-quadrant pump) driven at variable rpm by an electric motor 2 and having a tank port T and a working port P, a tank 4 as a hydraulic-fluid reservoir, a valve arrangement connected between working port P of hydraulic pump 3 and hydraulic cylinder-piston arrangement 1 and comprising several electrically activatable switching valves S1, S2, S3, S4, S5 and S6 and—not shown—a machine controller acting on switching valves S1 to S6 and on electric motor 2. Cylinder-piston arrangement 1 is of double-acting design; it has a first hydraulic working chamber 5 on the piston side and a second hydraulic working chamber 6 on the piston-rod side. The said cylinder-piston arrangement 1 is oriented in such a way with vertical axis of movement X of piston 7 that first hydraulic working chamber 5 is disposed above second hydraulic working chamber 6. Pressurization of first hydraulic working chamber 5 by means of hydraulic pump 3 results in a downward movement and pressurization of second working chamber 6 in an upward movement of piston 7. A servo-suction valve 8, through which first hydraulic working chamber 5 is filled with hydraulic fluid during a downward movement of piston 7 in rapid traverse, is connected between tank 4 and first hydraulic working chamber 5 of cylinder-piston arrangement 1.

The drive unit is provided with a hydraulic decompression module 9. This comprises a hydraulic accumulator 10, which can be placed in communication with the second hydraulic working chamber 6 via two different connecting lines 11 and 12, part of which, however, is a shared, common line section 13 having a loading/unloading valve 14 disposed therein. On the one hand, hydraulic accumulator 10 of hydraulic decompression module 9 can be placed in communication with second hydraulic working chamber 6 via a first connecting line 11 having a pressure-limiting valve 15 having flow direction from second hydraulic working chamber 6 to hydraulic accumulator 10; thus first connecting line 11 represents a "loading line" for hydraulic accumulator 10. And, on the other hand, hydraulic accumulator 10 can be placed in communication, via a second connecting line 12, with a check valve 16 opening in flow direction from hydraulic accumulator 10 to second hydraulic working chamber 6; thus second connecting line 12 represents an "unloading line" for hydraulic accumulator 10.

The said loading/unloading valve 14 opens (and closes) in pressure-controlled manner, i.e. in dependence on a control pressure, and in fact is actuated directly by the control pressure. The said control pressure is the pressure prevailing in first hydraulic working chamber 5. For this purpose, control-pressure line 17 of loading/unloading valve 14—which is designed as a hydraulically actuatable valve—communicates with first hydraulic working chamber 5. The switching-pressure threshold of loading/unloading valve 14 is adjusted such that the said valve already opens at the pressure established (due to pressure-limiting valve 15) in first hydraulic working chamber 5 at the beginning of the power mode.

Figure 2:
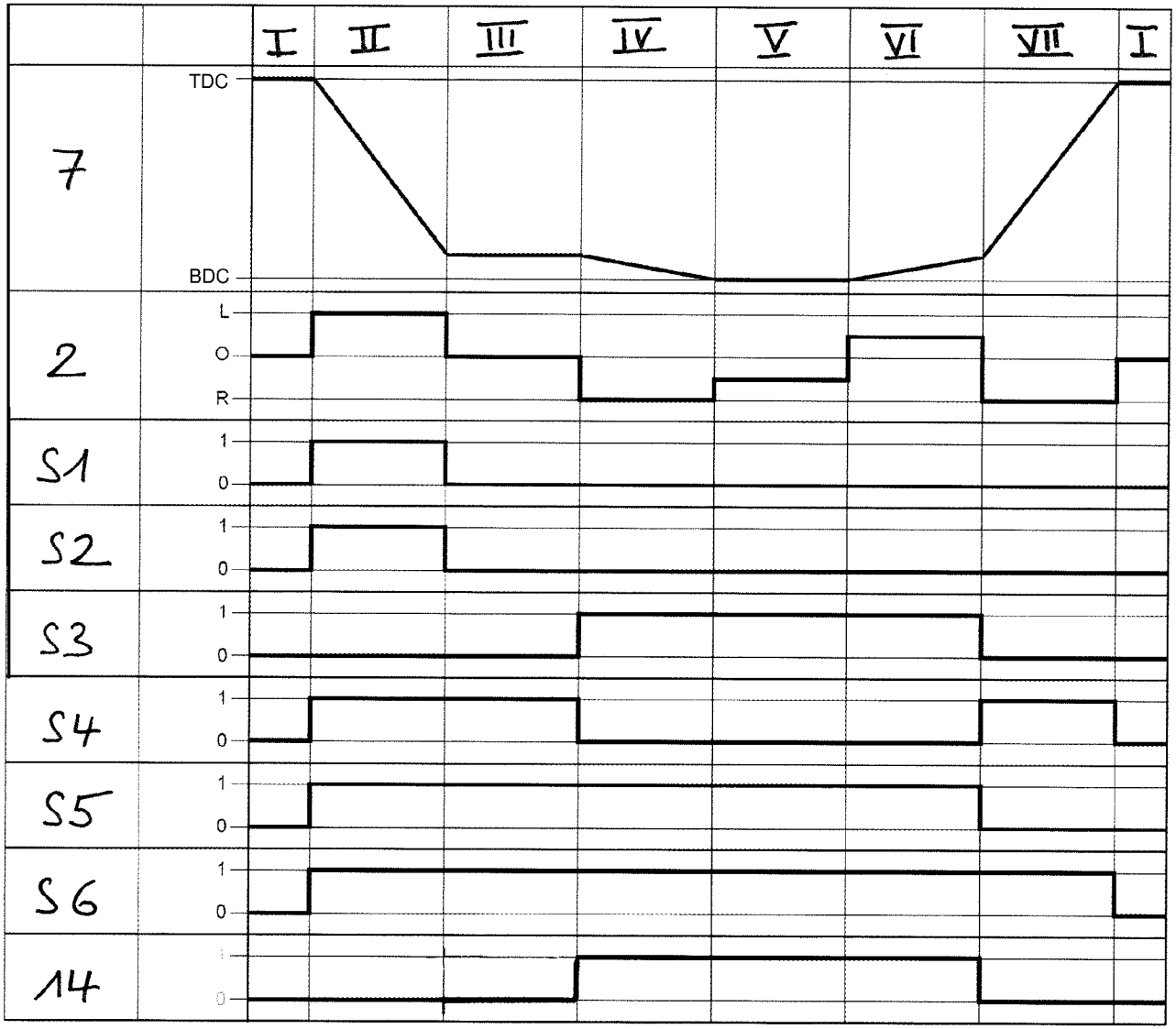

The actuation of switching valves S1 to S6 of the valve arrangement as well as of electric motor 2 by the machine controller and also the resulting movement of piston 7 between top dead center (TDC) and bottom dead center (BDC) during a complete working cycle are illustrated in the functional diagram according to FIG. 2. The switched situation of loading/unloading valve 14 that results during the working cycle due to its pressure-controlled actuation is likewise illustrated in FIG. 2. By appropriate activation of switching valves S1 to S6 and of electric motor 2—with optional pressurization of first hydraulic working chamber 5 or of second hydraulic working chamber 6 of cylinder-piston arrangement 1 in pumping or else in braking mode of hydraulic pump 3—it is therefore possible, during one working cycle, to execute the following phases for the illustrated electrohydraulic drive unit I: Holding of the piston at top dead center,
II: Downward rapid traverse of the piston,
III: Changeover phase
IV: Downward power mode of the piston,
V: Holding of the piston at bottom dead center and
VI: Decompression (together with active upward creep mode) and
VII: Upward movement of the piston in fast traverse.

This diagram of the switched and operating states is partly schematic, namely in the sense that an abrupt change is shown instead of the gradual change of rpm of the electric motor as explained in the foregoing. Accordingly, the piston movement is also impacted by unsteady phenomena.

If necessary, an additional "Slow upward" phase may be provided between the decompression phase (VI) and the upward movement of the piston in rapid traverse (VII). For this purpose, electric motor 2 driving hydraulic pump 3 is operated at first at rpm reduced compared with the upward rapid transverse phase (VII); and servo-suction valve 8 is not yet switched to passing state at first, by the fact that switching valve S5 remains energized at first, just as during phases II to VI, and so hydraulic fluid is displaced through the valve arrangement out of first hydraulic working chamber 5 and into tank 4.

For effective cleaning of the hydraulic fluid, a filter unit 18, by means of which the entire hydraulic fluid being conveyed by hydraulic pump 3 in pumping mode thereof is cleaned by filter 19, is connected between working port P of hydraulic pump 3 and the valve arrangement. It is only if filter 19 is clogged that the hydraulic fluid being conveyed by hydraulic pump 3 flows via the "small" bypass 20, in which check valve 21 acts as a pressure-limiting valve and opens when filter 19 is loaded or clogged, in order to prevent filter rupture. In braking mode of hydraulic pump 3, the hydraulic fluid flows via the "large" bypass 22 containing check valve 23 around filter unit 18.

In the embodiment of the invention illustrated in the drawing, the hydraulic decompression module, as explained, is connected—due to the abrupt pressure rise then occurring in the first hydraulic working chamber—at the beginning of the power mode, i.e. during the changeover phase, wherein simultaneously—by controlled closing of switching valve S2—the outflow of fluid displaced from the second hydraulic working chamber to the tank is suppressed. A shift, explained in the foregoing, of the connection of the hydraulic decompression module to a later operating point (for example the "clamping point" characterized by setting of the tool on the workpiece), by specification of an accordingly higher switching-pressure threshold for the loading/unloading valve, would go hand-in-hand with a modification of the hydraulic system. And, in fact, switching valve S2 would remain open correspondingly longer in this case, i.e. for at least during a first part of the power mode; and the outflow of the fluid displaced from the second hydraulic working chamber to the tank would be expediently suppressed simultaneously with the connection of the hydraulic decompression module (by hydraulic opening of the loading/unloading valve) by means of a valve that is likewise pressure-controlled and connected in series with switching valve S2.

If the loading/unloading valve of the hydraulic decompression module were to be actuated not hydraulically, as in the exemplary embodiment, but instead in electrically controlled manner, a corresponding coordinated connection of the hydraulic decompression module with simultaneous shutoff of the discharge to the tank (e.g. in position-controlled manner) could be realized particularly simply at any desired operating point of the power mode. In this case, the respective process control could be optimized in the sense of greatest possible efficiency without problems as a function of need.

What is claimed is:

1. An electrohydraulic drive unit, especially for use on a machine press, having a cylinder-piston arrangement (1) having a first hydraulic working chamber (5) on the piston side and a second hydraulic working chamber (6) on the piston-rod side a tank (4) as a hydraulic-fluid reservoir, a hydraulic pump (3) driven at variable rpm by an electric motor (2) and having a tank port (T) and a working port (P), a valve arrangement connected between the working port (P) of the hydraulic pump (3) and the cylinder-piston arrangement (1) and comprising several electrically activatable switching valves (S1-S6), a servo-suction valve (8) connected between the tank (4) and the first hydraulic working chamber (5) of the cylinder-piston arrangement (1), and a machine controller acting on the switching valves (S1-S6) and on the electric motor (2), by means of which the switching valves (S1-S6) can be reversed between pressurization of the first hydraulic working chamber (5) and of the second hydraulic working chamber (6) of the cylinder-piston arrangement (1) in pumping mode of the hydraulic pump (3) from its working port (P), wherein a hydraulic decompression module (9) having a hydraulic accumulator (10), which can be placed in communication with the second hydraulic working chamber (6) via a first connecting line (11) having a pressure-limiting valve (15) having flow direction from the second hydraulic working chamber (6) to the hydraulic accumulator (10) and via a second connecting line (12) having a check valve (16) opening in flow direction from the hydraulic accumulator (10) to the second hydraulic working chamber (6).

2. The electrohydraulic drive unit of claim 1, wherein the hydraulic decompression module (9) comprises a loading/unloading valve (14).

3. The electrohydraulic drive unit of claim 2, wherein the loading/unloading valve (14) is disposed in a line section (13) common to the first connecting line (11) and the second connecting line (12).

4. The electrohydraulic drive unit of claim 2, wherein the loading/unloading valve (14) opens in pressure-controlled manner, wherein the control-pressure line (17) communicates with the first hydraulic working chamber (5).

5. The electrohydraulic drive unit of claim 4, wherein the loading/unloading valve (14) is of pressure-actuated design.

6. The electrohydraulic drive unit of claim 4, wherein the loading/unloading valve (14) can be actuated by a pressure-controlled positioning drive.

7. The electrohydraulic drive unit of claim 2, wherein the loading/unloading valve (14) can be actuated by a sequence-controlled positioning drive, which communicates with the machine controller.

8. The electrohydraulic drive unit of claim 2, wherein the loading/unloading valve (14) can be manually actuated.

9. The electrohydraulic drive unit of claim 1, wherein the cylinder-piston arrangement (1) is oriented with at least substantially vertical axis of movement (X) of piston (7), wherein the first hydraulic working chamber (5) is disposed above second hydraulic working chamber (6).

10. The electrohydraulic drive unit of claim 1, wherein a filter unit (18) is connected between the working port (P) of the hydraulic pump (3) and the valve arrangement.

11. The electrohydraulic drive unit of claim 1, wherein the hydraulic pump (3) is designed as a 2-quadrant pump and can be reversed by means of the machine controller in braking mode such that the directions of rotation and flow are reversed compared with pumping mode.

* * * * *